US008588664B2

(12) United States Patent
Takagi et al.

(10) Patent No.: US 8,588,664 B2
(45) Date of Patent: Nov. 19, 2013

(54) DEVELOPING CARTRIDGE

(75) Inventors: Takeyuki Takagi, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 195 days.

(21) Appl. No.: 12/975,878

(22) Filed: Dec. 22, 2010

(65) Prior Publication Data

US 2011/0158704 A1 Jun. 30, 2011

(30) Foreign Application Priority Data

Dec. 25, 2009 (JP) ..... 2009-294591

(51) Int. Cl.
*G03G 15/08* (2006.01)

(52) U.S. Cl.
USPC ..... 399/279; 399/119

(58) Field of Classification Search
USPC ..... 399/279
See application file for complete search history.

(56) References Cited

U.S. PATENT DOCUMENTS

| | | | | |
|---|---|---|---|---|
| 5,559,581 | A * | 9/1996 | Sugiura et al. | 399/111 |
| 2003/0185594 | A1* | 10/2003 | Okabe | 399/222 |
| 2005/0031359 | A1* | 2/2005 | Ishii | 399/12 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0159485 | A1* | 7/2006 | Nishimura et al. | 399/109 |
| 2006/0171739 | A1* | 8/2006 | Nakaya | 399/119 |
| 2007/0059038 | A1* | 3/2007 | Shiraki | 399/119 |
| 2007/0122165 | A1* | 5/2007 | Igarashi et al. | 399/12 |
| 2009/0169255 | A1* | 7/2009 | Sato | 399/119 |

FOREIGN PATENT DOCUMENTS

| | | | |
|---|---|---|---|
| JP | H06-048606 | A | 2/1994 |
| JP | H08-048432 | A | 2/1996 |
| JP | H10-161477 | A | 6/1998 |
| JP | 2000-131950 | A | 5/2000 |
| JP | 2002-040808 | A | 2/2002 |

(Continued)

OTHER PUBLICATIONS

Japan Patent Office, Notification of Reasons for Refusal for Japanese Patent Application No. 2009-294591 (counterpart to above-captioned patent application), dispatched Oct. 25, 2011.

(Continued)

*Primary Examiner* — Clayton E LaBalle
*Assistant Examiner* — Jas Sanghera
(74) *Attorney, Agent, or Firm* — Baker Botts L.L.P.

(57) ABSTRACT

A developing cartridge includes: a developing roller that is rotatable about a developing roller axis line, which extends in a predetermined direction; a supply roller, which is rotatable about a supply roller axis line, which extends in the predetermined direction, and which supplies developer to the developing roller; a developing roller driving gear that is connected to the developing roller; a supply roller driving gear that is connected to the supply roller; and a driving force transmission gear, which is rotatable about a gear axis line extending in the predetermined direction, and which includes: a first gear part meshed with the developing roller driving gear; and a second gear part meshed with the supply roller driving gear. The driving force transmission gear transmits driving force to the developing roller driving gear and the supply roller driving gear.

7 Claims, 10 Drawing Sheets

(56) References Cited

FOREIGN PATENT DOCUMENTS

| | | | |
|---|---|---|---|
| JP | 2003-091184 | A | 3/2003 |
| JP | 2006-072284 | A | 3/2006 |
| JP | 2007-168561 | A | 7/2007 |
| JP | 2008-268685 | A | 11/2008 |
| JP | 2008-289239 | A | 11/2008 |

OTHER PUBLICATIONS

European Patent Office, extended European Search Report for European Patent Application No. 10015970.6 (counterpart to above-captioned patent application), dated Dec. 27, 2011.

Japan Patent Office, Notification of Reason for Refusal for Japanese Patent Application No. 2011-278537 (counterpart to above-captioned patent application), dispatched May 29, 2012.

Japan Patent Office, Notification of Reason for Refusal for Japanese Patent Application No. 2009-294591 (counterpart to above-captioned patent application), dispatched May 29, 2012.

Japan Patent Office, Decision of Refusal for Japanese Patent Application No. 2009-294591 (counterpart Japanese patent application), dispatched Nov. 6, 2012.

* cited by examiner

DEVELOPING CARTRIDGE

CROSS-REFERENCE TO RELATED APPLICATIONS

This application claims priority from Japanese Patent Application No. 2009-294591 filed on Dec. 25, 2009, the entire subject matter of which is incorporated herein by reference.

TECHNICAL FIELD

Apparatuses and devices consistent with the invention relates to a developing cartridge that is detachably mounted to a main body of an image forming apparatus.

BACKGROUND

An image forming apparatus that forms an image electrophotographically such as laser printers includes a photosensitive drum, on which an electrostatic latent image is formed, and a developing cartridge that develops the electrostatic latent image formed on the photosensitive drum.

The developing cartridge includes a developing roller and a supply roller for supplying toner to the developing roller. One sidewall of the developing cartridge includes a gear device unit for driving the developing roller and the supply roller. The gear device unit includes an input gear, to which driving force from a main body of the apparatus is input, a developing roller driving gear, which is attached to an end portion of a developing roller shaft of the developing roller and which meshes with the input gear, and a supply roller driving gear, which is attached to an end portion of a supply roller shaft of the supply roller and which meshes with the input gear. In other words, the developing roller driving gear attached to the end portion of the developing roller shaft of the developing roller and the supply roller driving gear attached to the end portion of the supply roller shaft of the supply roller are meshed with the same gear teeth of the input gear, to which driving force from the main body is input.

When forming an image, driving force is input to the input gear from the main body, so that the input gear is rotated. As the driving force is transmitted to the developing roller driving gear and the supply roller driving gear from the input gear, the developing roller is rotated via the developing roller driving gear and the supply roller is rotated via the supply roller driving gear.

SUMMARY

In order to prevent toner from being deteriorated, it may be considered to reduce circumferential speed of the supply roller so as to decrease friction occurring between the supply roller and the developing roller. For example, it is possible to reduce the circumferential speed of the supply roller by enlarging a gear diameter of the supply roller driving gear.

In order to favorably supply toner to the developing roller from the supply roller, the developing roller and the supply roller contact each other with a nip width therebetween. The nip width is determined in accordance with diameters of the developing roller and the supply roller and a distance between the developing roller shaft and the supply roller shaft. According thereto, it is difficult to reduce the circumferential speed of the supply roller by changing the diameters of the developing roller and the supply roller and the distance between the developing roller shaft and the supply roller shaft. In addition, since the circumferential speed (rotational speed) of the developing roller is a factor that has the most significant impact on a developing process, it is hard to easily change a gear diameter of the developing roller driving gear so as to keep desired circumferential speed. Thus, it has been considered to change a gear diameter of the supply roller driving gear or a position of the input gear so as to reduce the circumferential speed of the supply roller. However, there is a limit on the reduction of the circumferential speed of the supply roller due to space restraints.

In addition, since both the developing roller driving gear and the supply roller driving gear are meshed with the input gear, the gear teeth of the input gear may be easily worn. When the gear teeth of the input gear are worn, the developing roller is not stably driven, so that a toner image formed by the developing roller may be deteriorated.

Therefore, illustrative aspects of the invention provide a developing cartridge capable of highly changing circumferential speed of a supply roller and reducing a degree of wear of a gear unit, which transmits driving force to a developing roller driving gear and a supply roller driving gear.

According to one illustrative aspect of the invention, there is provided a developing cartridge that is detachably mounted to a main body of an image forming apparatus, the developing cartridge comprising: a developing roller that is rotatable about a developing roller axis line, which extends in a predetermined direction; a supply roller, which is rotatable about a supply roller axis line, which extends in the predetermined direction, and which supplies developer to the developing roller; a developing roller driving gear that is connected to the developing roller; a supply roller driving gear that is connected to the supply roller; and a driving force transmission gear, which is rotatable about a gear axis line extending in the predetermined direction, and which comprises: a first gear part meshed with the developing roller driving gear; and a second gear part meshed with the supply roller driving gear, wherein the driving force transmission gear transmits driving force to the developing roller driving gear and the supply roller driving gear.

According to another illustrative aspect of the invention, there is provided a developing cartridge comprising: a housing comprising: an upper wall; a bottom wall; and a pair of opposing side walls bridging the upper wall and bottom wall; a developing roller, which is rotatable about a developing roller axis line that extends between the pair of opposing side walls, wherein the developing roller comprises a developing roller shaft, which extends along the developing roller axis line and penetrates at least one of the pair of opposing side walls; a supply roller, which is rotatable about a supply roller axis line, which extends between the pair of opposing side walls, wherein the supply roller comprises a supply roller shaft, which extends along the supply roller axis line and penetrates the at least one of the pair of opposing side walls; a developing roller driving gear attached to the developing roller shaft, wherein the developing roller driving gear is fixed to the developing roller shaft to not rotate relative to the developing roller shaft and wherein the developing roller driving gear is fixed to the developing roller shaft to be restrained from moving axially along the developing roller shaft; a supply roller driving gear attached to the supply roller shaft; wherein the supply roller driving gear is fixed to the supply roller shaft to not rotate relative to the supply roller shaft; a driving force transmission gear rotatably attached to an outside of one of the pair of opposing side walls, wherein the driving force transmission gear comprises: a first gear part, which is disposed near the one of the pair of opposing side walls, and which meshes with the developing roller driving gear; a second gear part, which is disposed on a side of the first gear part farthest from the one of the pair of opposing side walls, and which meshes with the supply roller driving gear; and a coupling member disposed on a side of the second gear part farthest from the first gear part, wherein the second gear part has a diameter smaller than a diameter of the first gear part, wherein the first gear part has a first helical tooth pattern, which has a tooth trace that follows a predetermined helix pitch, wherein the second gear part has a second helical tooth pattern, which has a tooth trace that follows a helix pitch having a direction opposite the predetermined helix pitch followed by the first helical tooth pattern, and wherein the driving force transmission gear receives a driving force through a connection part formed on a face of the coupling member and transmits the received driving force to the developing roller driving gear and the supply roller driving gear.

According thereto, the developing cartridge includes the developing roller and the supply roller. The developing roller is provided so that the developing roller is rotatable about the developing roller shaft line extending in a predetermined direction. The developing roller is connected with the developing roller driving gear. The supply roller is provided so that the supply roller is rotatable about a supply roller axis line extending in a predetermined direction. The supply roller is connected with the supply roller driving gear. In addition, the developing cartridge includes the driving force transmission gear for transmitting driving force to the developing roller driving gear and the supply roller driving gear. The driving force transmission gear has the first gear part and the second gear part and is rotatable about a gear axis line extending in a predetermined direction. The developing roller driving gear and the supply roller driving gear are meshed with the first gear part and the second gear part, respectively. According thereto, it is possible to highly change the circumferential speed of the supply roller by changing each gear diameter of the second gear part and the supply roller driving gear, without changing the circumferential speed of the developing roller.

In addition, since the developing roller driving gear and the supply roller driving gear are meshed with the separate gear parts, it is possible to reduce a degree of wear of the gear parts, compared to a structure in which the developing roller driving gear and the supply roller driving gear are meshed with the same gear part.

DETAILED DESCRIPTION

Hereinafter, an exemplary embodiment of the invention will be described in detail with reference to the drawings.

(1) Printer

Figure 1:
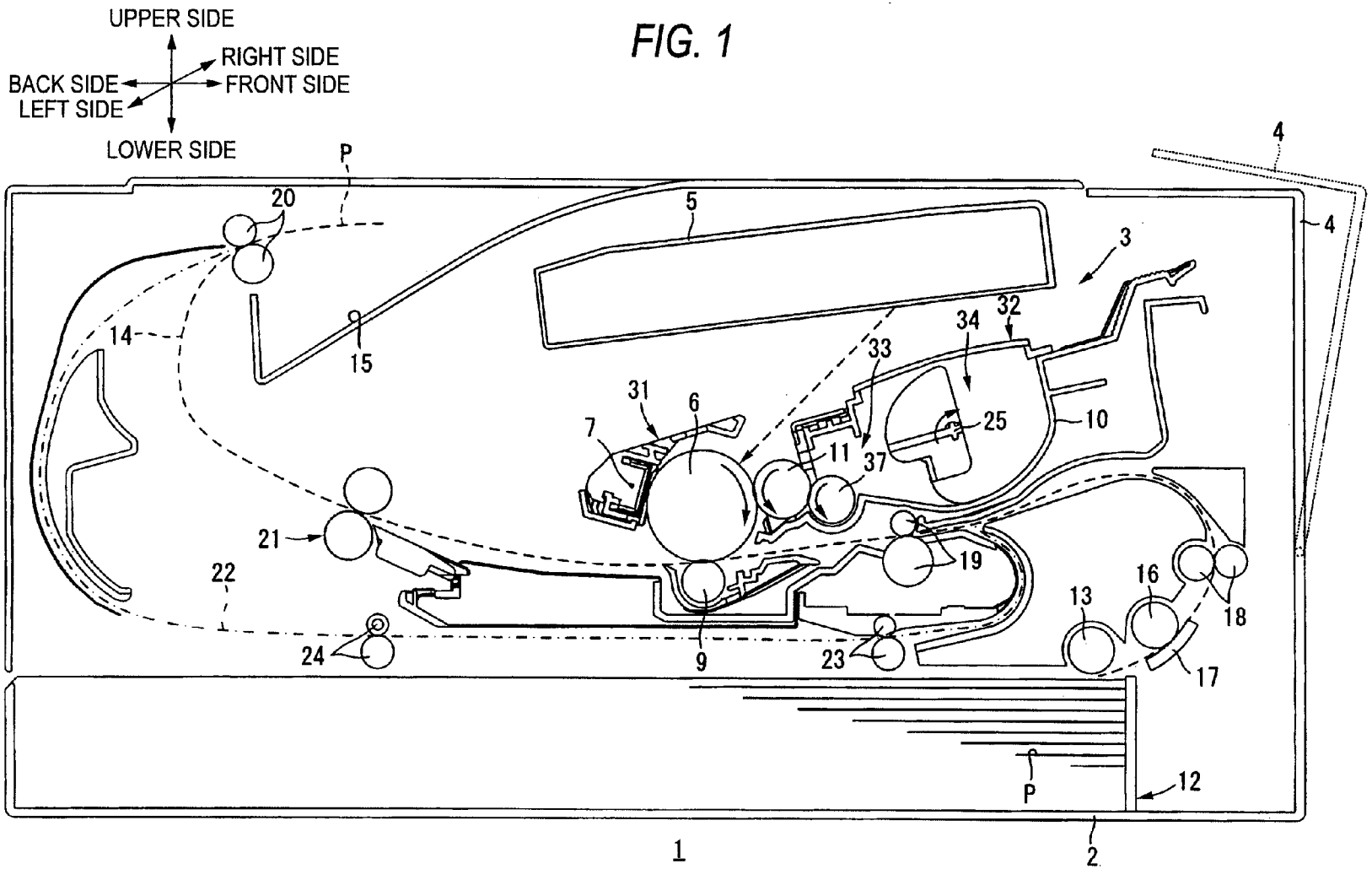
FIG. 1 is a side sectional view of a printer having a developing cartridge according to an exemplary embodiment of the invention.

As shown in FIG. 1, a printer 1 (one example of an image forming apparatus) includes a body casing 2 (one example of a main body).

A process cartridge 3 is provided at a center portion in the body casing 2. The process cartridge 3 is detachably mounted to the body casing 2 via a front cover 4 that is provided at one sidewall of the body casing 2.

In the following descriptions, a side at which the front cover 4 is provided to the body casing 2 is referred to as the front side and a side opposite to the front side is referred to as the back side. In addition, the left and the right are assigned based on viewing the printer from the front side of the printer 1. Additionally, regarding a developing cartridge 32, which will be described later, the front, back, left and right are set based on the state in which the developing cartridge is mounted to the body casing 2.

The process cartridge 3 includes a drum cartridge 31 and a developing cartridge 32. The developing cartridge 32 is detachably mounted to the drum cartridge 31.

The drum cartridge 31 is provided with a rotatable photosensitive drum 6. The drum cartridge 31 includes a charger 7 and a transfer roller 9.

The photosensitive drum 6 is rotatable about an axis line extending in a direction perpendicular to a sheet face of FIG. 1.

The charger 7 is a scorotron-type charger and is arranged to be opposite to a circumferential surface of the photosensitive drum 6 with a predetermined interval provided between the charger 7 and the photosensitive drum.

The developing cartridge 32 includes a developing housing 10 (one example of the housing) that accommodates toner. In the developing housing 10, a developing chamber 33 and a toner accommodating chamber 34 (one example of a developer accommodating chamber), which accommodates toner supplied to the developing chamber 33, are provided adjacent to each other.

A developing roller 11 and a supply roller 37 are held in the developing chamber 33 such that the developing roller 11 and the supply roller 37 are rotatable with respect to the developing chamber 33.

The developing roller 11 has a circumferential surface, a part of which is exposed from a back end portion of the developing housing 10. In addition, the supply roller 37 has a circumferential surface that contacts a front side of the developing roller 11. The developing cartridge 32 is mounted to the drum cartridge 31 so that the part of the developing roller 11 exposed from the developing housing 10 contacts a circumferential surface of the photosensitive drum 6.

An agitator 25 is kept in the toner accommodating chamber 34 such that the agitator 25 is rotatable with respect to the toner accommodating chamber 34. Toner in the toner accommodating chamber 34 is supplied into the developing chamber 33 while being agitated by rotation of the agitator 25.

The transfer roller 9 is provided at a lower side of the photosensitive drum 6. The transfer roller 9 is rotatable about an axis line parallel to a rotation axis line of the photosensitive drum 6 and is arranged so that a circumferential surface of the transfer roller 9 contacts the circumferential surface of the photosensitive drum 6.

In the body casing 2, an exposure unit 5 that can emit laser and the like is arranged above the process cartridge 3.

When forming an image, the photosensitive drum 6 rotates at a constant speed in a clockwise direction in FIG. 1. In accordance with rotation of the photosensitive drum 6, the circumferential surface of the photosensitive drum 6 is uniformly charged by electric discharge from the charger 7. In the meantime, based on image data received from a personal computer (not shown) connected to the printer 1, a laser beam is emitted from the exposure unit 5. The laser beam passes between the charger 7 and the developing cartridge 32 and is irradiated on the circumferential surface of the photosensitive drum 6 that is positively charged to be uniform. Thereby, the circumferential surface of the photosensitive drum 6 is selectively exposed, and the electric charges are selectively removed from the exposed part, so that an electrostatic latent image is formed on the circumferential surface of the photosensitive drum 6. When the electrostatic latent image is opposed to the developing roller 11 by rotation of the photosensitive drum 6, toner is supplied to the electrostatic latent image from the developing roller 11. Thereby, a toner image is formed on the circumferential surface of the photosensitive drum 6.

A sheet feeding cassette 12 that stores sheets P is arranged at a bottom part of the body casing 2. A pickup roller 13 for sending the sheet from the sheet feeding tray 12 is provided above the sheet feeding cassette 12.

A conveyance path 14, which has an S shape when seen from the side face, is formed in the body casing 2. The conveyance path 14 reaches a sheet discharge tray 15 formed at an upper surface of the body casing 2 via a portion between the photosensitive drum 6 and the transfer roller 9 from the sheet feeding cassette 12. A separation roller 16 and a separation pad 17, which are arranged to be opposite to each other, a pair of feeder rollers 18, a pair of register rollers 19 and a pair of sheet discharge rollers 20 are provided on the conveyance path 14.

The sheets P are fed from the sheet feeding cassette 12 one at a time while passing between the separation roller 16 and the separation pad 17. Then, the sheet P is fed toward the register rollers 19 by the feeder rollers 18. Then, the sheet P is registered by the register rollers 19 and is conveyed toward a portion between the photosensitive drum 6 and the transfer roller 9 by the register rollers 19.

The toner image formed on the circumferential surface of the photosensitive drum 6 is electrically attracted and transferred on the sheet P by the transfer roller 9 when the toner image is opposed to the sheet P passing between the photosensitive drum 6 and the transfer roller 9 by the rotation of the photosensitive drum 6.

On the conveyance path 14, a fixing unit 21 is provided at a downstream side of a conveyance direction of the sheet P from the transfer roller 9. The sheet P, on which the toner image is transferred, is conveyed through the conveyance path 14 and passes through the fixing unit 21. The fixing unit 21 fixes the toner image on the sheet P by heating and pressing so as to form an image on the sheet P.

As operation modes, the printer 1 includes a one-sided mode for forming an image (toner image) on one side of the sheet P and a duplex mode for forming an image on one side of the sheet P and then forming an image on the other side of the sheet P.

In the one-sided mode, the sheet P having an image formed on one side thereof is discharged to the sheet discharge tray 15 by the sheet discharge rollers 20.

As a structure for realizing the duplex mode, the body casing 2 is formed therein with a reverse conveyance path 22. The reverse conveyance path 22 extends between the conveyance path 14 and the sheet feeding cassette 12 from the vicinity of the sheet discharge rollers 20 and is connected to a part between the feeder rollers 18 and the register rollers 19 on the conveyance path 14. On the reverse conveyance path 22, a pair of first reverse conveying rollers 23 and a pair of second reverse conveying rollers 24 are provided.

In the duplex mode, the sheet P having an image formed on one side thereof is conveyed to the reverse conveyance path 22 rather than being discharged to the sheet discharge tray 15. Then, the sheet P is conveyed through the reverse conveyance path 22 by the first reverse conveying rollers 23 and the second reverse conveying rollers 24 and two sides thereof are reversed, so that the other side of the sheet P, on which no image is formed, is sent to the conveyance path 14 with being opposed to the circumferential surface of the photosensitive drum 6. Then, an image is formed on the other side of the sheet P, so that the images are formed on both sides of the sheet P.

(2) Developing Cartridge

The developing housing 10 of the developing cartridge 32 has a box shape having an opened back side.

Figure 2:
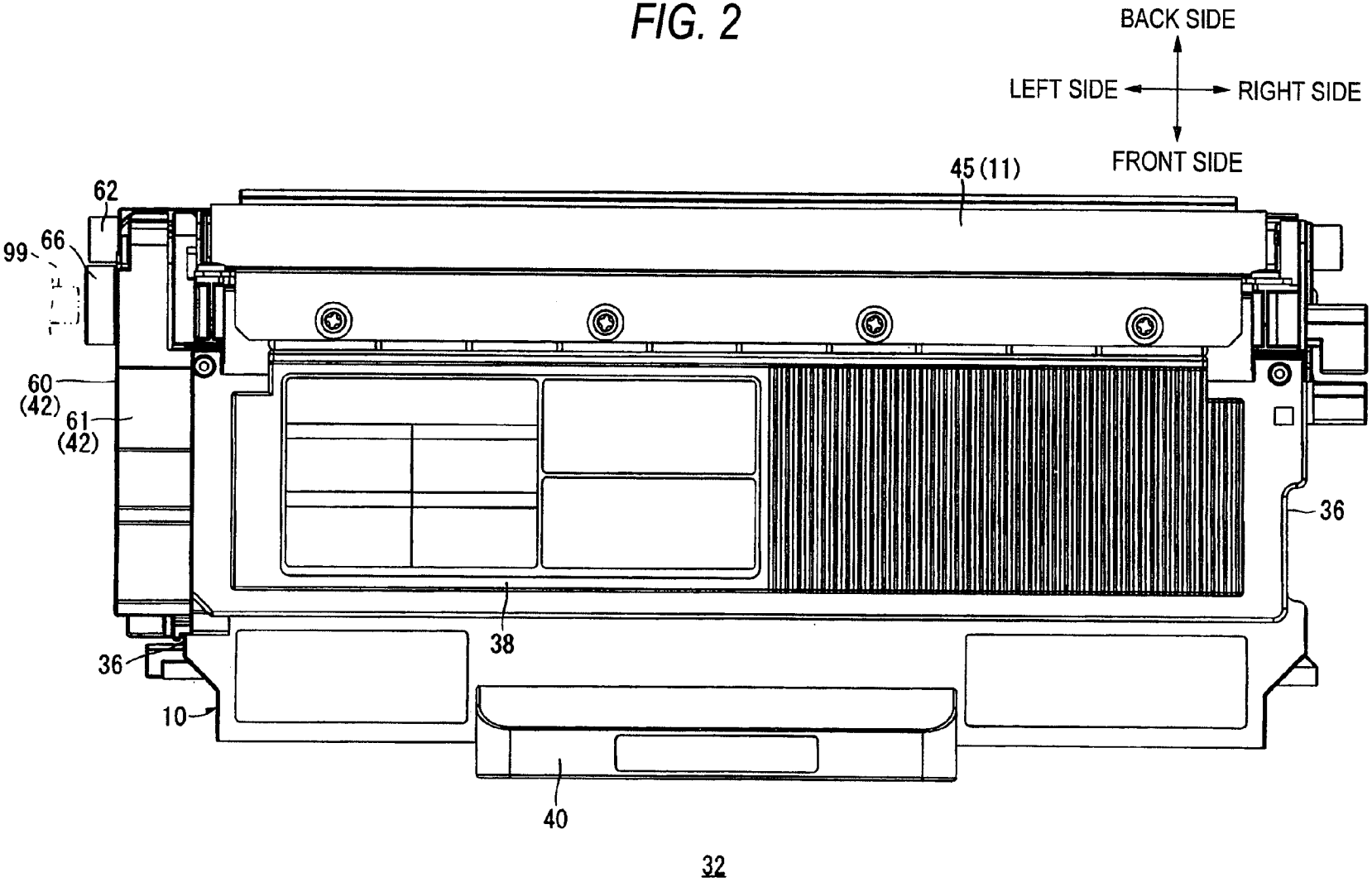
FIG. 2 is a plan view of the developing cartridge.
Figure 3:
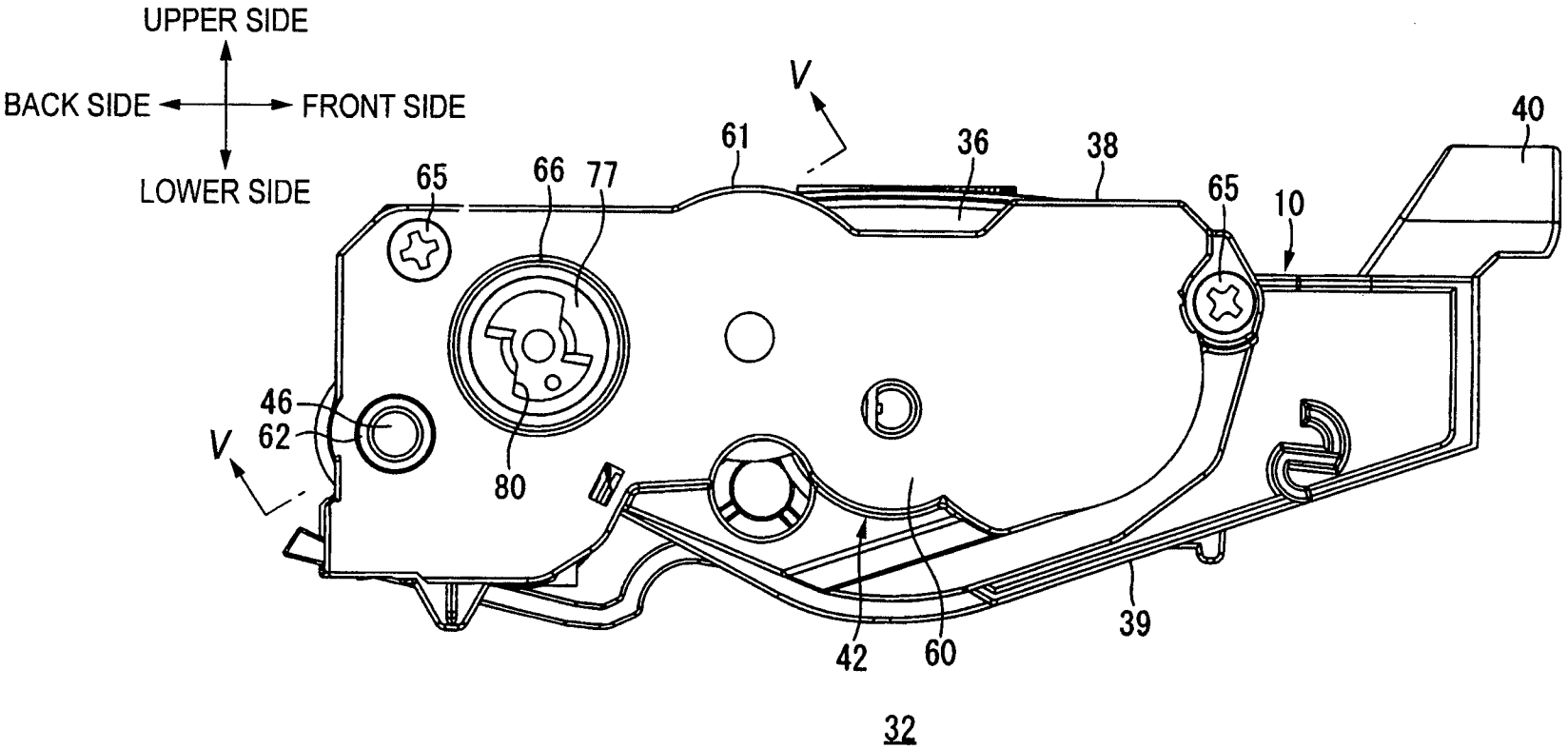
FIG. 3 is a left side sectional view of the developing cartridge.

As shown in FIG. 2, the developing housing 10 includes a pair of sidewalls 36, which are opposed to each other in the left-right direction. As shown in FIGS. 2 and 3, an upper wall 38 and a bottom wall 39 are bridged between the sidewalls 36. The upper wall 38 and the bottom wall 39 are connected at a front end portion of the developing housing 10. The connected part includes a holding part 40. The holding part 40 is extended toward the front-upper direction from the front end portion of the developing housing 10 and has a sectional U shape having an opened front side.

The developing roller 11 and the supply roller 37 (refer to FIG. 1) are rotatably held between the sidewalls 36.

(2-1) Developing Roller

Figure 5:
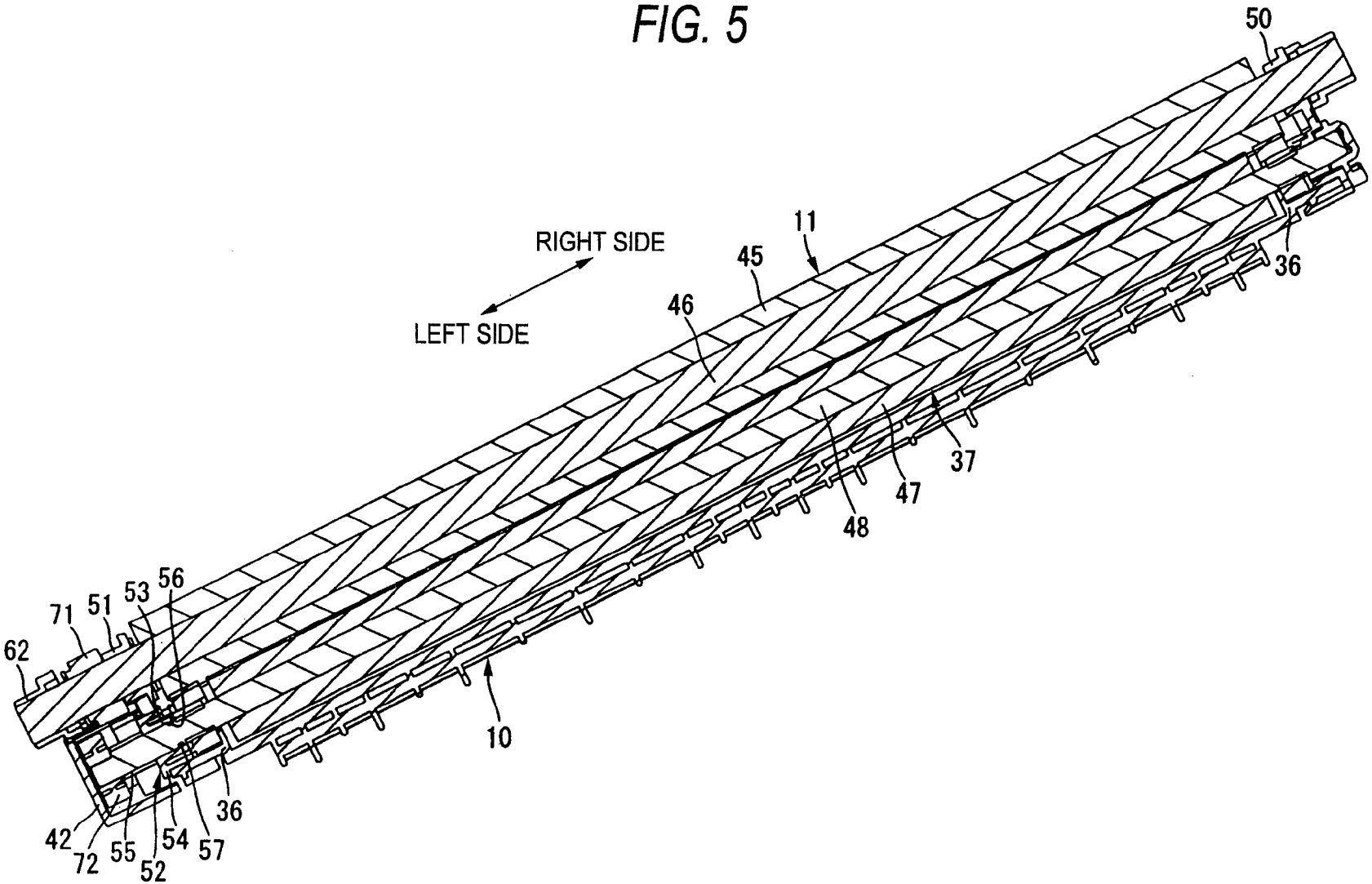
FIG. 5 is a sectional view of the developing cartridge taken along a line V-V of FIG. 3.

As shown in FIGS. 2 and 3, the developing roller 11 is arranged between back end portions of the sidewalls 36. As shown in FIG. 5, the developing roller 11 includes a cylindrical developing roller main body extending in the left-right direction and a developing roller shaft 46 extending along a central axis line of the developing roller main body 45.

Both end portions of the developing roller shaft 46 penetrate the sidewalls 36 of the housing 10.

(2-2) Supply Roller

As shown in FIG. 1, the supply roller 37 is arranged at a position of the front-lower direction of the developing roller 11. As shown in FIG. 5, the supply roller 37 includes a cylindrical supply roller main body 47 extending in the left-right direction and a supply roller shaft 48 extending along a central axis line of the supply roller main body 47.

A circumferential surface of the supply roller body 47 contacts a circumferential surface of the developing roller body 45 from a front-lower side.

Both end portions of the supply roller shaft 48 penetrate both sidewalls 36 of the developing housing 10.

(2-3) Bearing Member

As shown in FIG. 5, a right bearing member 50 is provided at an outer side of the right sidewall 36. The right end portions of the developing roller shaft 46 and the supply roller shaft 48 are supported by the right sidewall 36 via the right bearing member 50 so that the developing roller shaft 46 and the supply roller shaft 48 can be rotated relative to each other. In other words, the right bearing member 50 collectively holds the right end portion of the developing roller shaft 46 and the right end portion of the supply roller shaft 48.

As shown in FIG. 5, a developing bearing member 51 and a supply bearing member 52 are provided at an outer side of the left sidewall 36.

The developing bearing member 51 has a cylindrical shape and is attached to the left sidewall 36 so that the developing bearing member 51 cannot be rotated relative to the left sidewall 36. The developing roller shaft 46 is inserted into the developing bearing member 51. Thereby, the left end portion of the developing roller shaft 46 is connected to the left sidewall 36 via the developing bearing member 51 so that the left end portion of the developing roller shaft 46 can be rotated relative to the developing bearing member.

The supply bearing member 52 integrally has an engage part 53, a flange part 54 and a spacer 55.

The engage part 53 has a substantially cylindrical shape. The engage part 53 is attached to the left sidewall 36 so that the engage part 53 cannot be rotated relative to the left sidewall. A hook portion 56 is formed at a right end portion of the engage part 53. The hook portion 56 is bent toward the supply roller shaft 48. The supply roller shaft 48 is formed at a position opposite to the hook potion 56 with an engaged recess 57 that is notched from the circumferential surface of the supply roller shaft along a peripheral direction. The hook portion 56 is wedged into the engaged recess 57, so that the supply roller shaft 48 is positioned in an axis line direction thereof (left-right direction).

Figure 9:
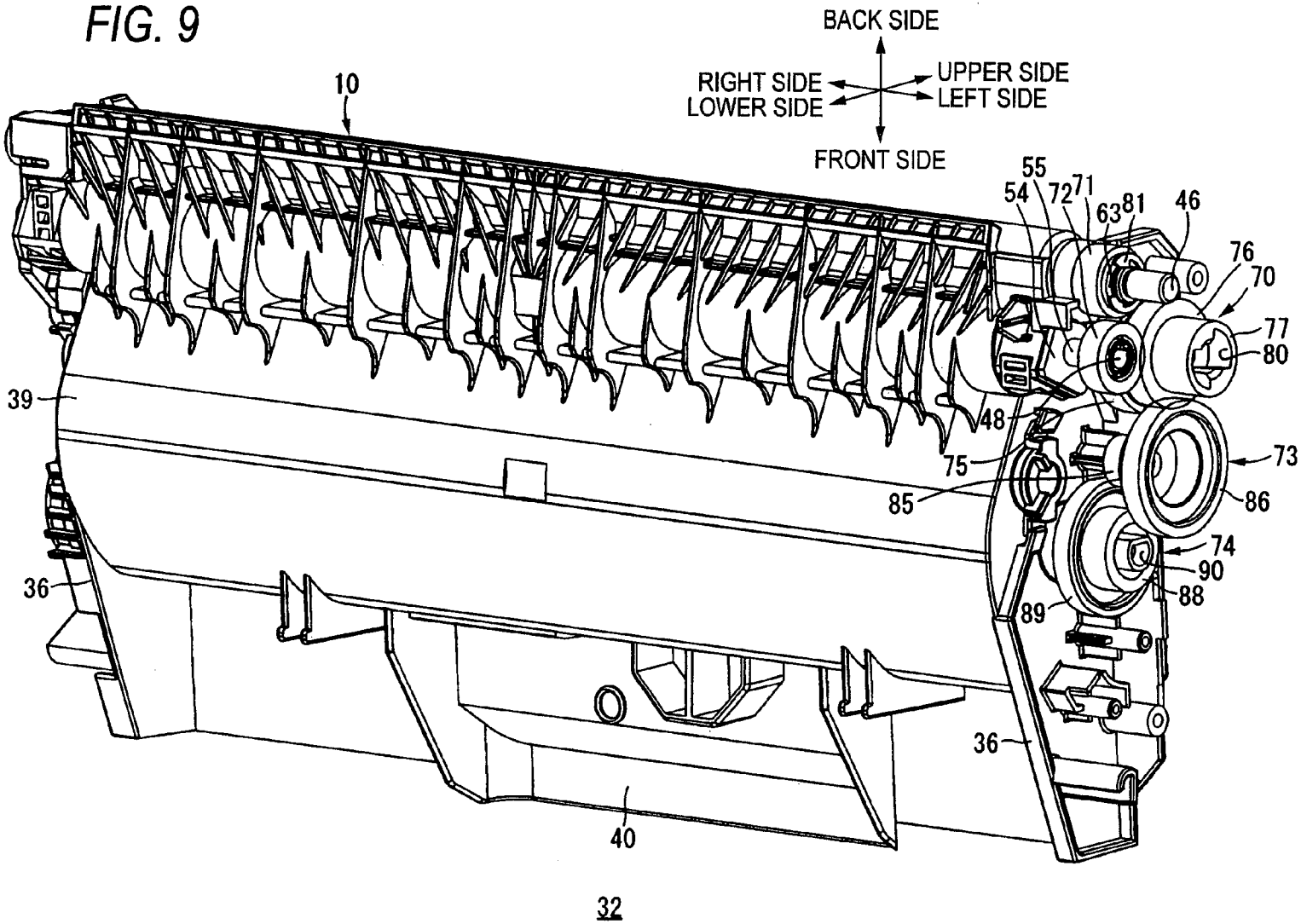
FIG. 9 is a perspective view of the developing cartridge showing a state in which a gear cover is detached.

As shown in FIG. 9, the flange part 54 has a substantially rectangular shape. The flange part 54 contacts the left sidewall 46 from the left side.

As shown in FIGS. 5 and 9, the spacer 55 has a cylindrical shape. The supply roller shaft 48 is inserted into the spacer 55.

Thereby, the left end portion of the supply roller shaft 48 is attached to the left sidewall 36 via the supply bearing member 52 so that the left end portion of the supply roller shaft 48 can be rotated relative to the supply bearing.

(2-4) Gear Device

Figure 4:
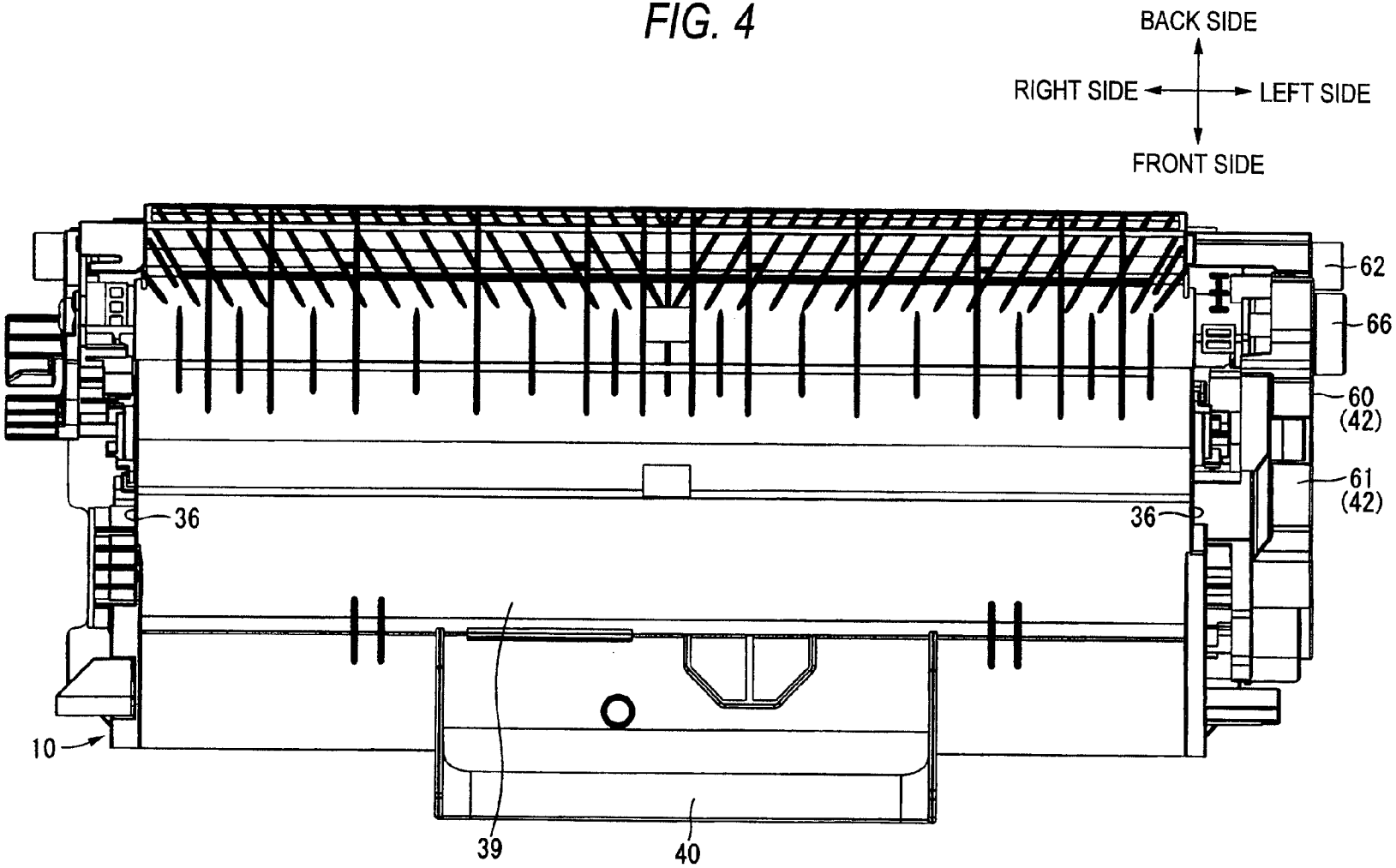
FIG. 4 is a bottom view of the developing cartridge.

As shown in FIGS. 2 to 4, a gear cover 42 is mounted to the left end portion of the developing cartridge 32.

(2-4-1) Gear Cover

The gear cover 42 integrally has a side plate 60 that is opposed to the left sidewall 36 from the left side and a circumferential plate 61 that extends from a circumferential edge of the side plate 60 toward the developing housing 10.

As shown in FIG. 3, the side plate 60 has a plate shape extending in the front-rear and upper-lower directions and has a size that is opposed to a substantially entire area of the developing chamber 33 and the toner accommodating chamber 34 (refer to FIG. 1).

As shown in FIGS. 3 and 5, the left end portion of the developing roller shaft 46 is protruded from the gear cover 42 in the left direction, and a cylindrical collar member 62 is attached to the protruded portion of the left end portion of the developing roller shaft 46.

In addition, front end portion and rear end portion of the side plate 60 are formed with two screw holes (not shown). Screws 65 are engaged with the left sidewall 36 through the screw holes, so that the side plate 60 is fixed to the left sidewall 36 (developing housing 10).

Additionally, a coupling insertion part 66 is formed at a front-upper position regarding the collar member 62. The coupling insertion part 66 has a cylindrical shape protruding in a left direction. A coupling member 77, which will be described later, is inserted into the coupling insertion part 66 so that the coupling member 77 can be relatively rotated.

Figure 6:
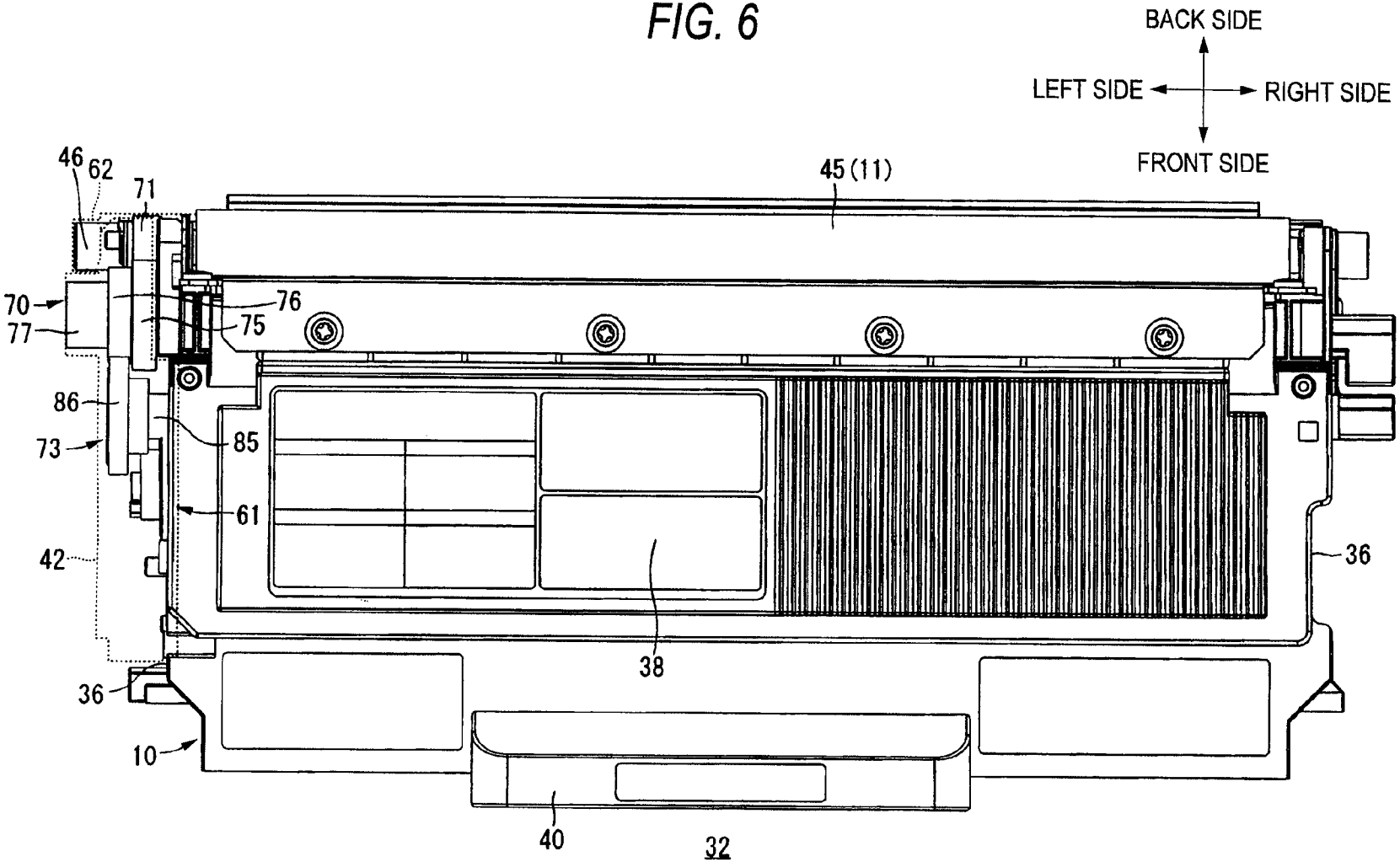
FIG. 6 is a plan view of the developing cartridge showing a state in which a gear cover is detached.

As shown with the dotted line in FIG. 6, a right end portion of the circumferential plate 61 (gear cover 42) is overlapped with the left sidewall 36 so that they are opposed to each other in the upper-lower direction.

(2-4-2) Gears

As shown in FIG. 6, an input gear 70 that is an example of the driving force transmission gear, a developing gear 71 that is an example of the developing roller driving gear, a supply gear 72 that is an example of the supply roller driving gear, a connection gear 73 and an agitator gear 74 are provided between the gear cover 42 and the left sidewall 36. Each of the gears 70 to 74 is rotatable about a rotation axis line of the left-right direction.

(2-4-2-1) Input Gear

Figure 7:
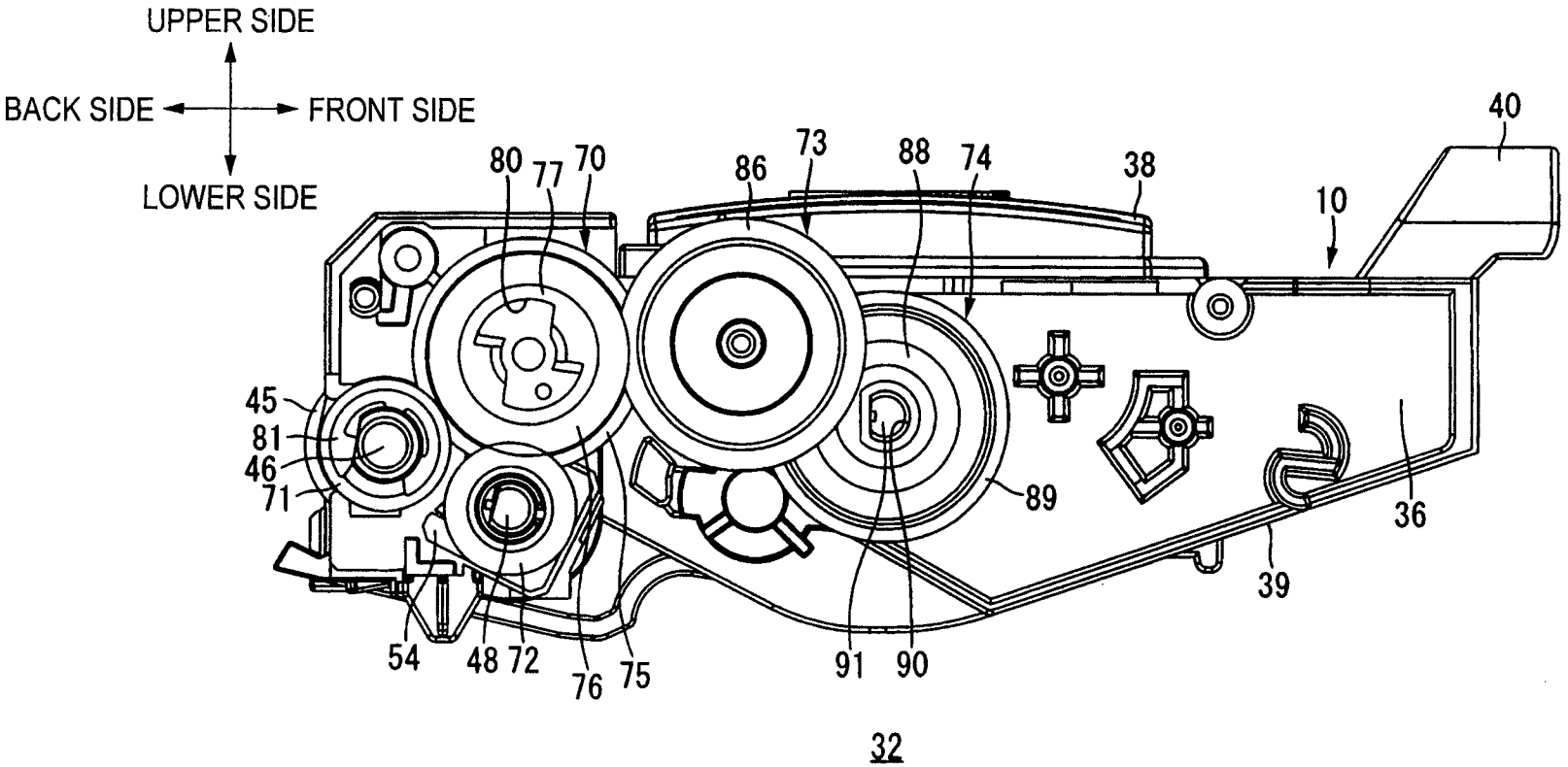
FIG. 7 is a left side sectional view of the developing cartridge showing a state in which a gear cover is detached.

As shown in FIG. 7, the input gear 70 is arranged at an upper side of the back end portion of the developing housing 10. The input gear 70 is supported to the left sidewall 36 so that it can be relatively rotated. As shown in FIGS. 6 to 9, the input gear 70 integrally has a first gear part 75, a second gear part 76 and a coupling member 77. The first gear part 75, the second gear part 76 and the coupling member 77 are arranged in sequence beginning from the sidewall 36.

Figure 10:
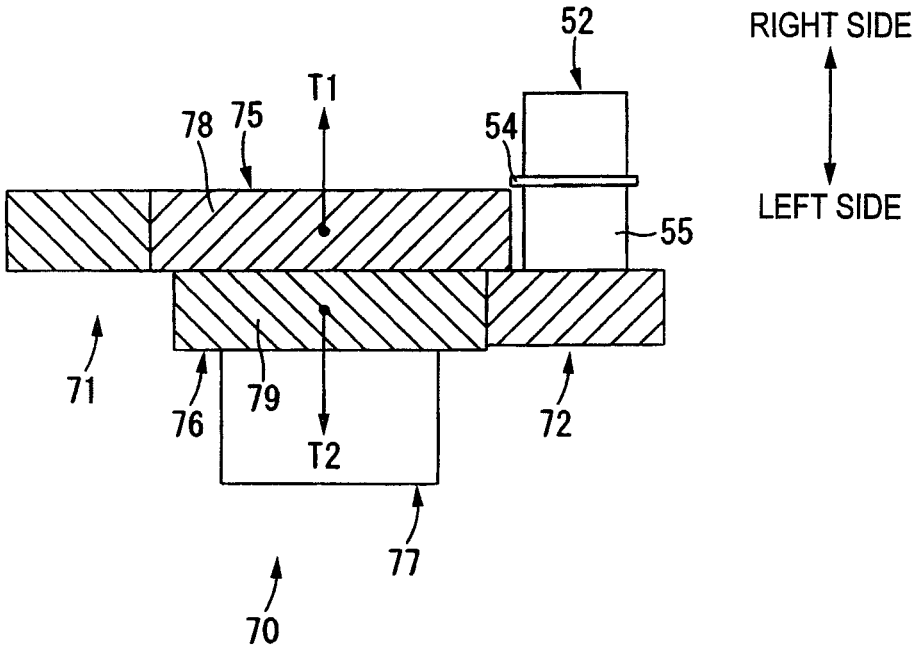
FIG. 10 is a schematic view for illustrating an engagement state of an input gear, a developing gear and a supply gear.

As shown in FIG. 10, a first helical tooth pattern 78 having a tooth trace that follows a predetermined helix pitch is formed on a circumferential surface of the first gear part 75.

The second gear part 76 has a diameter smaller than that of the first gear part 74. A second helical tooth pattern 79 is formed on a circumferential surface of the second gear part 76. The second helical tooth pattern 79 has a tooth trace that follow a helix pitch helix of a direction opposite the helical tooth pattern of the first gear part 75.

In other words, the first helical tooth. pattern 78 and the second helical tooth pattern 79 have tooth traces that follow the helix pitches of opposite directions.

As shown in FIGS. 3 and 7, a connection part 80 is formed at a left side face of the coupling member 77. The connection part 80 is formed by digging down from the left side face of the coupling member 77 to the right side and has a shape such that a part of a circle is partially notched from the circumference thereof into a fan shape.

(2-4-2-2) Developing Gear

Figure 8:
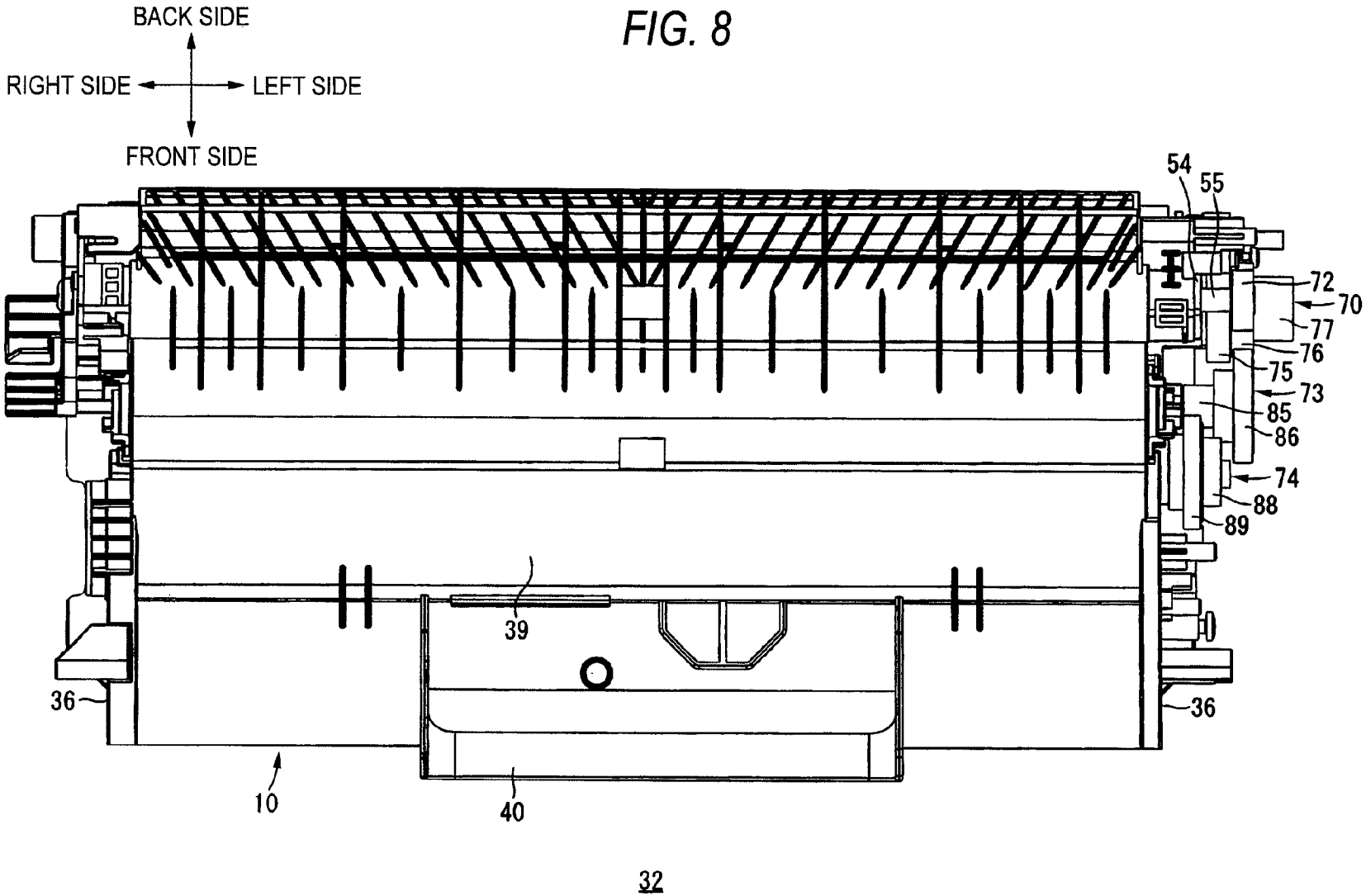
FIG. 8 is a bottom view of the developing cartridge showing a state in which a gear cover is detached.

As shown in FIGS. 7 to 9, the developing gear 71 is arranged at a rear-lower position regarding the input gear 70. The developing gear 71 is attached to the developing roller shaft 46 so that the developing gear 71 cannot be relatively rotated. The left end portion of the developing roller shaft 46 is protruded from the developing gear 71 in the left direction. A fixture 81 having a C-shape when seen from a side face is attached to the protruded portion of the left end portion of the developing roller shaft 46. Thereby, the developing gear 71 is restrained from moving in the axis line direction (left-right direction) of the developing roller shaft 46.

The developing gear 71 is meshed with the first gear part 75 of the input gear 70.

(2-4-2-3) Supply Gear

The supply gear 72 is arranged at a position below the input gear 70. As shown in FIGS. 5 and 9, the supply gear 72 is attached to the outer side of the spacer 55 of the supply bearing member 52 so that the supply gear 72 cannot be rotated relative to the supply roller shaft 48. Specifically, the left end portion of the supply roller shaft 48 is D-cut to have a D-shape section formed by partially cutting a part of the circumferential surface of the left end portion. The D-shape part of the left end portion of the supply roller shaft 48 is inserted into the supply gear 72. Accordingly, the supply gear 72 is attached to the supply roller shaft 48 such that the supply gear 72 cannot be relatively rotated. The left end portion of the supply roller shaft 48 is arranged at a more inner side (right side) than the left end face of the supply gear 72 and is inserted into the supply gear 72.

As shown in FIGS. 7 to 9, the supply gear 72 is meshed with the second gear part 76 of the input gear 70.

(2-4-2-4) Connection Gear

As shown in FIGS. 7 to 9, the connection gear 73 is arranged at the front of the input gear 70. The connection gear 73 integrally has a first gear part 85 and a second gear part 86, which have gear teeth on circumferential surfaces thereof.

The first gear part 85 and the second gear part 86 are arranged in a line in that order beginning at the sidewall 36.

The first gear part 85 has a cylindrical shape. The left sidewall 36 is formed with a support protrusion (not shown) that protrudes in the left direction. The support protrusion is inserted into the first gear part 85 so that the first gear part 85 can be rotated relative to the support protrusion. Thus, the connection gear 73 is by the left sidewall 36 so that the connection gear 73 can be rotated relative to the support protrusion.

The second gear part 86 has an outer diameter larger than the first gear part 85. The second gear part 86 is meshed with the second gear part 76 of the input gear 70.

(2-4-2-5) Agitator Gear

As shown in FIG. 7, the agitator gear 74 is arranged at a front-lower position regarding the connection gear 73. The agitator gear 74 integrally has a support part 88 and a gear part 89.

As shown in FIGS. 7 and 9, the support part 88 has a cylindrical shape. A central portion of the support part 88 is formed with a shaft insertion hole 90 having a D-shape, which penetrates the support part in an axis line direction thereof. An agitator shaft 91 is inserted into the shaft insertion hole 90 so that the agitator shaft 91 cannot be relatively rotated. Specifically, a left end portion of the agitator shaft 91 is D-cut to have a D-shape section formed by partially cutting a part of the circumferential surface of the left end portion. The D-shape part of the left end portion of the agitator shaft 91 is inserted into the shaft insertion hole 90. Accordingly, the agitator gear 74 is attached to the agitator shaft 91 such that the agitator gear 74 cannot be relatively rotated. The agitator shaft 91 is connected to the agitator 25 shown in FIG. 1. Thereby, when the agitator gear 74 is rotated, the agitator 25 is rotated via the agitator shaft 91.

The gear part 89 is meshed with the first gear part 85 of the connection gear 73.

(3) Structure in Body Casing

As shown with a phantom line in FIG. 2, a main body-side coupling 99, which is an example of a driving member, is provided in the body casing 2. The main body-side coupling 99 is arranged at a position opposed to the coupling member 77 (refer to FIG. 7) from the left direction in a state in which the developing cartridge 32 is attached to the body casing 2 (refer to FIG. 1). The main body-side coupling 99 has an engage protrusion (not shown) that protrudes in the right side.

After the mounting of the developing cartridge 32 to the body. casing 2 is completed, when the main body-side coupling 99 is advanced in the right side, the engage protrusion of the main body-side coupling 99 is inserted into the connection part 80 (refer to FIG. 7) of the coupling member 77. As the main body-side coupling 99 is further advanced toward the right side, the coupling member 77 is pressed in the right side. Thereby, the positioning of the input gear 70 in the left-right direction is achieved. After that, when rotation driving force is input to the main body-side coupling 99 from a motor (not shown), the coupling member 77 is rotated via the main body-side coupling 99.

Incidentally, the advancing of the main body-side coupling 99 in the right side can be interlocked with a closing operation of the front cover 4 shown in FIG. 1. Since the interlocking operation is known, detailed descriptions about the interlocking mechanism are omitted.

(4) Driving of Gears

When the main-body side coupling 99 is coupled to the coupling member 77 and rotational driving force is input to the input gear 70, the input gear is rotated in a clockwise direction in FIG. 7.

The first gear part 75 of the input gear 70 is meshed with the developing gear 71. According thereto, the developing gear 71 is rotated in the counterclockwise direction in FIG. 7 as the input gear 70 is rotated. Thereby, the developing roller 11 (refer to FIG. 1) is rotated in the counterclockwise direction in FIG. 1 via the developing gear 71.

In addition, as shown in FIG. 10, thrust force T1 that acts in the right direction is generated to the input gear 70 by the first helical tooth pattern 78 formed on the first gear part 75 of the input gear 70.

As shown in FIG. 7, the second gear part 76 of the input gear 70 is meshed with the supply gear 72. According thereto, the supply gear 72 is rotated in the counterclockwise direction in FIG. 7 as the input gear 70 is rotated. Thereby, the supply roller 37 (refer to FIG. 1) is rotated in the counterclockwise direction in FIG. 1 via the supply gear 72.

At this time, as shown in FIG. 10, thrust force T2 that acts in the left direction is generated to the input gear 70 by the second helical tooth pattern 79 formed on the second gear part 76 of the input gear 70.

As shown in FIG. 7, since the second gear part 76 has the gear diameter smaller than that of the first gear part 75, the rotational speed of the supply gear 72 meshed with the second gear part 76 is slower than the rotational speed of the developing gear 71 meshed with the first gear part 75. Thus, the circumferential speed of the supply roller 37 (refer to FIG. 1) is slower than the circumferential speed of the developing roller 11.

In addition, the second gear part 76 of the input gear 70 is meshed with the second gear part 86 of the connection gear 73. According thereto, the connection gear 73 is rotated in the counterclockwise direction in FIG. 7 as the input gear 70 is rotated.

The first gear part 85 of the connection gear 73 is meshed with the gear part 89 of the agitator gear 74. According thereto, the agitator gear 74 is rotated in the clockwise direction in FIG. 7 as the connection gear 73 is rotated. Thereby, the agitator 25 (refer to FIG. 1) is rotated in the clockwise direction in FIG. 1 via the agitator gear 74.

As described above, the developing cartridge 32 includes the developing roller 11 and the supply roller 37. The developing roller 11 is rotatable about the developing roller shaft 46 extending in the left-right direction. The developing roller 11 is connected with the developing gear 71. The supply roller 37 is rotatable about the supply roller shaft 48 extending in the left-right direction. The supply roller 37 is connected with the supply gear 72. The developing cartridge 32 further includes the input gear 70 for transmitting driving force to the developing gear 71 and the supply gear 72. The input gear 70 has the first gear part 75 and the second gear part 76 and is rotatable about the gear axis line extending in the left-right direction. The developing gear 71 and the supply gear 72 are meshed with the first gear part 75 and the second gear part 76, respectively. According thereto, it is possible to highly change the circumferential speed of the supply roller 37 by changing each gear diameter of the second gear part 76 and the supply gear 72, without changing the circumferential speed of the developing roller 11.

In addition, since the developing gear 71 and the supply gear 72 are meshed with the separate gear parts 75, 76, it is possible to reduce a degree of wear of the gear parts 75, 76, compared to a structure in which the developing gear 71 and the supply gear 72 are meshed with the same gear part.

Additionally, the first gear part 75 and the second gear part 76 generate the thrust forces T1, T2 that are opposite to each other, when the input gear 70 is rotated. Thereby, when the input gear 70 is rotated, it is possible to prevent the input gear 70 from being biased in one of the left and right directions.

In addition, the first gear part 75 and the second gear part 76 are formed with the first helical tooth pattern 78 and the second helical tooth pattern 79, respectively. The first helical tooth pattern 78 and the second helical tooth pattern 79 have the tooth traces to follow the same helix pitches but with different directions with respect to each other. Thereby, when the input gear 70 is rotated, it is possible to generate the thrust forces T1, T2, which are opposite to each other, to the first gear part 75 and the second gear part 76.

Additionally, the connection part 80 of the input gear 70 is connected with the main body-side coupling 99 for inputting driving force, from the left side. Thereby, it is possible to input the driving force to the input gear 70 from the main body-side coupling 99 and to transmit the driving force to the developing roller 11 through the developing gear 71 and to the supply roller 37 through the supply gear 72.

In addition, the gear diameter of the first gear part 75 is larger than the gear diameter of the second gear part 76. Thereby, the rotational speed of the supply gear 72 meshed with the second gear part 76 is slower than that of the developing gear 71 meshed with the first gear part 75 and the circumferential speed of the supply roller 37 is slower than that of the developing roller 11. According thereto, it is possible to reduce the friction between the supply roller 37 and the developing roller 11. Thus, it is possible to suppress the deterioration of toner due to the friction between the supply roller 37 and the developing roller 11.

In addition, the developing housing 10 of the developing cartridge 32 includes the sidewalls 36, which are opposed to the developing roller 11 and the supply roller 37 from the left and right directions. Additionally, the developing gear 71, the supply gear 72 and the input gear 70 are collectively covered by the gear cover 42. In addition, the gear cover 42 is partially overlapped with the developing housing 10. Thereby, it is possible to prevent foreign substances from being introduced from between the gear cover 42 and the developing housing 10. Accordingly, it is possible to prevent the inferior engagement due to the introduction of the foreign substances into the meshed parts between the respective gears.

(6) Modified Exemplary Embodiment

The invention has been described with reference to the exemplary embodiment. However, the invention may be embodied in another exemplary embodiment.

For example, in the above-described exemplary embodiment, a white-black printer has been described as an example of the image forming apparatus. However, a color printer may be adopted as an example of the image forming apparatus. In this case, the invention can be applied to a developing cartridge that is detachably mounted to the color printer.

In addition, the first gear part 75 and the second gear part 76 may be integrally formed with an integral molding technology using resin materials. Alternatively, the first gear part and the second gear part may be individually formed and then connected in the axial direction so that they have a common axis line.

What is claimed is:

1. A developing cartridge comprising:

a developing roller configured to rotate about a developing roller axis line, which extends from a plane;

a supply roller configured to rotate about a supply roller axis line, which extends parallel to the developing roller axis line, and configured to supply developer to the developing roller;

a housing having a pair of opposing sidewalls that support the developing roller and the supply roller from both sides thereof, one sidewall of the pair of opposing sidewalls defining the plane;

a developing roller driving gear that is connected to the developing roller;

a supply roller driving gear that is connected to the supply roller; and a driving force transmission gear configured to rotate about a gear axis line, which extends parallel to the developing roller axis line, the driving force transmission gear comprising:

a first gear part meshed with the developing roller driving gear; and a second gear part meshed with the supply roller driving gear, wherein the driving force transmission gear is configured to transmit a driving force to each of the developing roller driving gear and the supply roller driving gear, wherein the developing roller driving gear is disposed nearer to the plane than the supply roller driving gear and is restrained from moving toward the plane along a direction parallel to the developing roller axis line, and wherein the first gear part forms a first helical tooth pattern and the second gear part forms a second helical tooth pattern, wherein the first helical tooth pattern and the second helical tooth pattern comprise respective tooth traces that follow respective helix pitches of directions different from each other, wherein the first gear part is configured to generate a first force when the driving force transmission gear is rotated, wherein the second gear part is configured to generate a second force when the driving force transmission gear is rotated, the second force being in a direction opposite to a direction of the first force and parallel to the developing roller axis line, wherein the second force is directed away from the plane, and wherein the first force and the second force prevent the developing roller driving gear and the supply roller driving gear from moving in a direction parallel to the gear axis line.

2. The developing cartridge according to claim 1, wherein the driving force transmission gear further comprises a connection part disposed further from the plane than both the first gear part and the second gear part and configured to receive a driving force therethrough.

3. The developing cartridge according to claim 1, wherein a gear diameter of the first gear part is larger than a gear diameter of the second gear part.

4. The developing cartridge according to claim 1, further comprising:

a gear cover that collectively covers the developing roller driving gear, the supply roller driving gear, and the driving force transmission gear, wherein the gear cover is overlapped with at least a portion of the housing.

5. The developing cartridge according to claim 1, wherein the first gear part and the second gear part are formed integrally.

6. A developing cartridge comprising:

a housing comprising:

an upper wall;

a bottom wall; and a pair of opposing side walls bridging the upper wall and bottom wall;

a developing roller configured to rotate about a developing roller axis line, which extends between the pair of opposing side walls, wherein the developing roller comprises a developing roller shaft, which extends along the developing roller axis line and penetrates at least one side wall of the pair of opposing side walls;

a supply roller configured to rotate about a supply roller axis line, which extends between the pair of opposing side walls, wherein the supply roller comprises a supply roller shaft, which extends along the supply roller axis line and penetrates the at least one side wall of the pair of opposing side walls;

a developing roller driving gear attached to the developing roller shaft, wherein the developing roller driving gear is fixed to the developing roller shaft, such that the developing roller driving gear is restrained from rotating relative to the developing roller shaft and restrained from moving axially along the developing roller shaft;

a supply roller driving gear attached to the supply roller shaft;

wherein the supply roller driving gear is fixed to the supply roller shaft, such that the supply roller driving gear is restrained from rotating relative to the supply roller shaft;

a driving force transmission gear rotatably attached to an first outer side of one side wall of the pair of opposing side walls, the first outer side being a side of the one side wall that faces away from the other side wall of the pair of opposing side walls, wherein the driving force transmission gear comprises:

a first gear part that is disposed near the one side wall and meshes with the developing roller driving gear;

a second gear part that meshes with the supply roller driving gear and is disposed on a second outer side of the first gear part, the second outer side being a side of the first gear part that is farthest from the one side wall; and a coupling member disposed on a third outer side of the second gear part, the third outer side being a side of the second gear part that is furthest from the first gear part, wherein the second gear part has a diameter that is less than a diameter of the first gear part, wherein the first gear part forms a first helical tooth pattern with a first tooth trace that follows a first predetermined helix pitch of a first direction, wherein the second gear part forms a second helical tooth pattern with a second tooth trace that follows a second helix pitch of a second direction that is opposite to the first direction, wherein the driving force transmission gear is configured to receive a driving force through a connection part formed on a face of the coupling member and is configured to transmit the received driving force to the developing roller driving gear and the supply roller driving gear, wherein the developing roller driving gear is disposed nearer to the one side wall than the supply roller driving gear and is restrained from moving toward the one side wall along the developing roller axis line, wherein the first gear part is configured to generate a first force when the driving force transmission gear is rotated, wherein the second gear part is configured to generate a second force when the driving force transmission gear is rotated, the second force being in a direction opposite to a direction of the first force and parallel to the developing roller axis line, wherein the second force is directed away from the one side wall, wherein the first force and the second force prevent the developing roller driving gear and the supply roller driving gear from moving in a direction parallel to the gear axis line.

7. The developing cartridge according to claim 6, wherein the first gear part and the second gear part are formed integrally.

* * * * *